United States Patent [19]

Marasco et al.

[11] Patent Number: 4,982,945

[45] Date of Patent: Jan. 8, 1991

[54] PLURAL MODE DOCUMENT RESTACKING TRAY FOR A COPIER DOCUMENT HANDLER

[75] Inventors: Joseph Marasco, Rochester; Moto Sugiyama, Fairport, both of N.Y.

[73] Assignee: Xerox Corporation, Stamford, Conn.

[21] Appl. No.: 447,150

[22] Filed: Dec. 6, 1989

[51] Int. Cl.[5] ..... B65H 31/00

[52] U.S. Cl. ..... 271/213; 271/207; 271/223

[58] Field of Search ..... 271/207, 213, 214, 223, 271/9; 400/605, 646–647.1

[56] References Cited

U.S. PATENT DOCUMENTS

| | | | |
|---|---|---|---|
| 4,191,467 | 3/1980 | Schieck | 355/27 |
| 4,754,960 | 7/1988 | Muller | 271/9 |
| 4,761,663 | 8/1988 | Piatt et al. | 400/647 |

FOREIGN PATENT DOCUMENTS

| | | | |
|---|---|---|---|
| 78875 | 5/1984 | Japan | 400/605 |

OTHER PUBLICATIONS

Ryan, R. A., et al., "Forms Stacking Aid", *IBM Technical Disclosure Bulletin,* vol. 20, No. 1 (Jun 1977), p. 97.

*Primary Examiner*—H. Grant Skaggs
*Assistant Examiner*—Steve Reiss

[57] ABSTRACT

For a copier with a document handler ejecting original documents after copying into a document collection tray system, a plural mode document collecting system is provided for collecting and restacking different forms of documents, including both conventional sheet documents and computer form web being re-fanfolded, with a single tray movable between two different operative tray mounting positions in a substantially vertical track, with respective retentions at a first tray position adjacent the document output of the document handler for collecting conventional sheet documents, and a second tray position substantially below the first tray position for re-fanfolding computer form web. Also disclosed are stationary fanfold restacking assist members operative in the second tray position mounted intermediately of the first and second tray mounting positions and mutually adapted with the tray to allow the tray to be moved past. Also shown is an optional small document restacking guide pop-up surface optionally operative in the first tray mounting position for restacking small documents closer to the document output of the document handler.

5 Claims, 4 Drawing Sheets

PLURAL MODE DOCUMENT RESTACKING TRAY FOR A COPIER DOCUMENT HANDLER

There is disclosed herein an improvement in original document handling for copiers, with a plural mode restacking tray for desirably collecting either sheet documents or computer form (CF) fanfolded web documents in the same tray in two different desired positions.

The disclosed system is particularly useful for collecting the output of a dual mode type of automatic document feeder capable of automatically feeding either conventional cut sheet type documents or CF web to and from the imaging station of a copier. Some examples of such document feeders are shown in Xerox Corporation U.S. Ser. No. 07/414,797 filed Sept. 29, 1989 (D/89169), or in Xerox Corp. U.S. Pat. No. 4,794,429, and other art cited therein, but are not limited thereto.

The terms copier and document handler as used herein are intended to include electronic document readers or scanners and their document feeders as well as conventional xerographic and other copiers.

There is disclosed herein a low cost and simple system for changing from the collection and stacking of copied regular sheet documents in a first location substantially in the plane of a copier imaging station to the refolding or fanfold restacking of an elongated computer form (CF) web document in a second location substantially below the plane of the copier imaging station, and providing a suitable drop zone therefore, without requiring two separate upper and lower restacking trays for the two separate restacking locations, and without having to remove an upper tray to allow a proper restacking path into a lower tray.

Typically, for prior art copiers such as the Xerox Corporation "1090" copier, two separate document restacking trays were required for document restacking after documents were fed to the platen or other imaging station of a copier by the automatic document feeder. One tray was for restacking regular document sheets at the platen exit level. That tray typically has to be removed or pivoted down to allow for restacking CF fanfold in a much lower, separate, special CF restacking tray, to provide the desired CF web drop distance and guidance for the CF fanfold to properly refold (restack) in that separate CF restacking tray.

Various types of regular sheet document and computer form (CF) fanfolded web document restacking trays are known in the art. The following patent disclosures are noted as examples: Xerox Corporation U.S. Pat. No. 4,754,960, and Xerox Corporation U.S. Statutory Invention Registration SIR H17 published Feb. 4, 1986, and various other art noted therein.

A specific feature of the specific embodiment disclosed herein is to provide for a copier with a document handler ejecting from its document output original documents being copied into a document collection tray system, the improvement comprising a plural mode document collecting system for collecting and restacking different forms of documents, including both conventional sheet documents and computer form web being re-fanfolded, with a single tray means movable between two different operative tray mounting positions, including a first tray position of said tray means adjacent said document output of said document handler for collecting conventional sheet documents and a second tray position substantially below said first tray position for re-fanfolding computer form web.

Further specific features provided by the system disclosed herein, individually or in combination, include those wherein, stationary fanfold restacking assist means are mounted intermediately of said first and second tray mounting positions and operative in said second tray position to assist in re-fanfolding computer form web, said fanfold restacking assist means and said tray means being mutually adapted to allow said tray means to be moved past said fanfold restacking assist means; and/or further including small document restacking guide means optionally operative in said first tray mounting position for restacking small documents closer to said document output of said document handler; and/or wherein said tray means is slidably movable between said first and second tray mounting positions in substantially vertical track means and has respective retention means for retaining said tray means in either of said first and second tray mounting positions.

All references cited in this specification, and their references, are incorporated by reference herein where appropriate for appropriate teachings of additional or alternative details, features, and/or technical background.

Various of the above-mentioned and further features and advantages of the invention will be apparent from the apparatus and its operation described in the specific example below. Thus, the present invention will be better understood from the following description of this exemplary embodiment thereof, including the drawing figures (approximately to scale) wherein.

Figure 1:
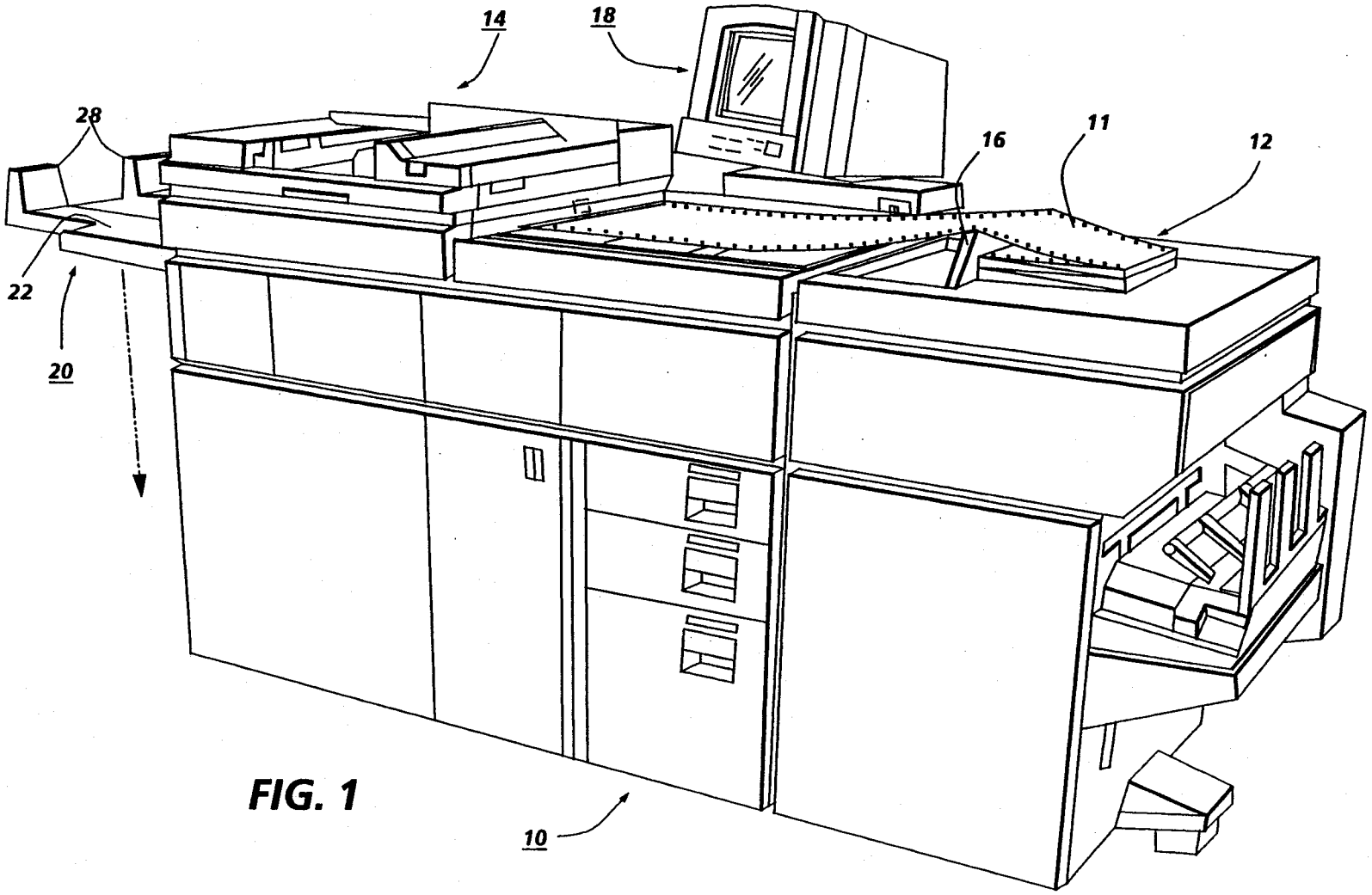
FIG. 1 is a perspective front view of one embodiment of the present document restacking system as mounted to one embodiment of an exemplary copier with an exemplary dual mode automatic document feeder as cited above.

Describing now in further detail the exemplary embodiment with reference to these Figures, there is shown by way of one example a xerographic copier type of reproducing machine 10 feeding and copying CF web 11 from a fanfolded web supply 12 to a dual mode automatic document handler (DH) or feeder 14 (over a CF web guide 16). The DH 14 is of the above-cited type into which either regular cut sheet documents or CF web 11 may be loaded and fed in a known manner. Here, both types of documents are collected after copying and ejection from the DH 14 in the restacking tray unit 20, to be described herein with particular reference to FIGS. 2–4.

The copy sheets made from imaging the documents on the copier imaging station or platen (under the DH 14) are ejected and stacked in the copy sheet exit tray shown at the right hand side of the copier 10 in FIG. 1. The copier 10 and its DH 14 are preferably controlled by a generally conventional programmable controller, as disclosed in, e.g., U.S. Pat. No. 4,475,156 and art cited therein. Here this machine control includes a known touch-screen operator input control and display 18.

Figure 2:
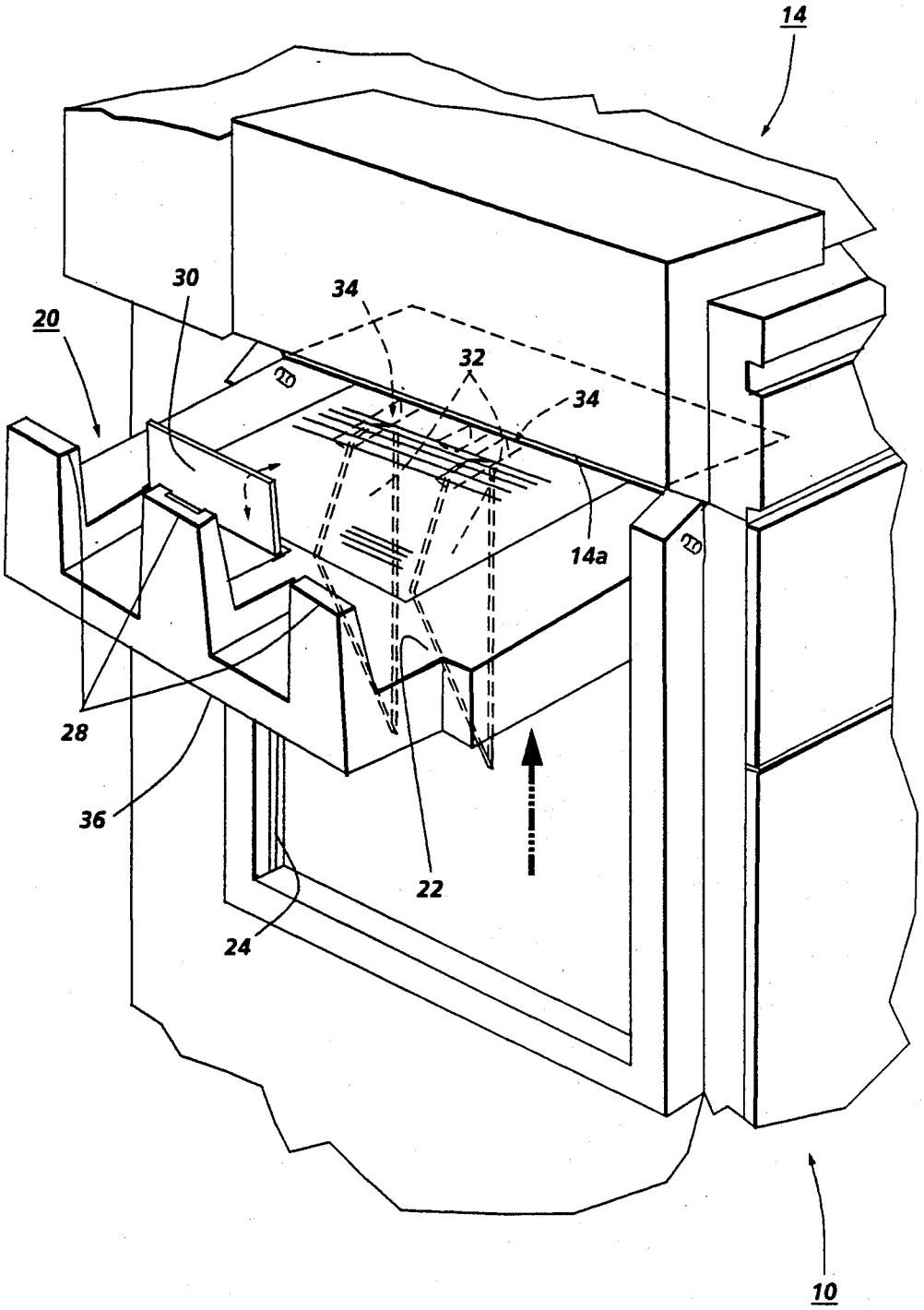
FIG. 2 is a perspective end view of the document restacking system embodiment portion of FIG. 1, with the document stacking tray unit in its up or normal cut sheet document collecting position.
Figure 3:
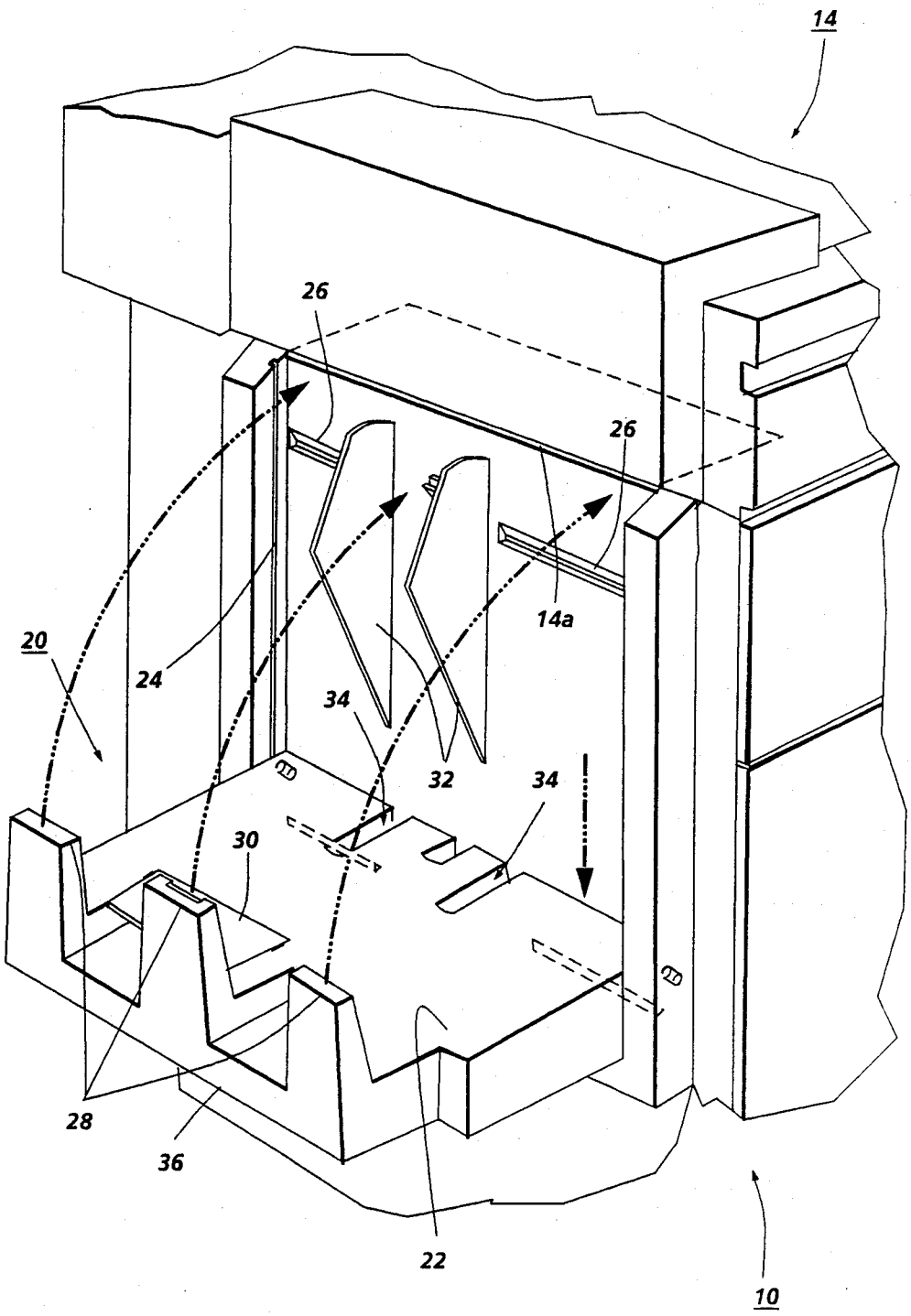
FIG. 3 is another perspective end view, but with the document stacking tray unit in its lower or CF web fanfold restacking position, and with its alternative folded up position shown by arrows.
Figure 4:
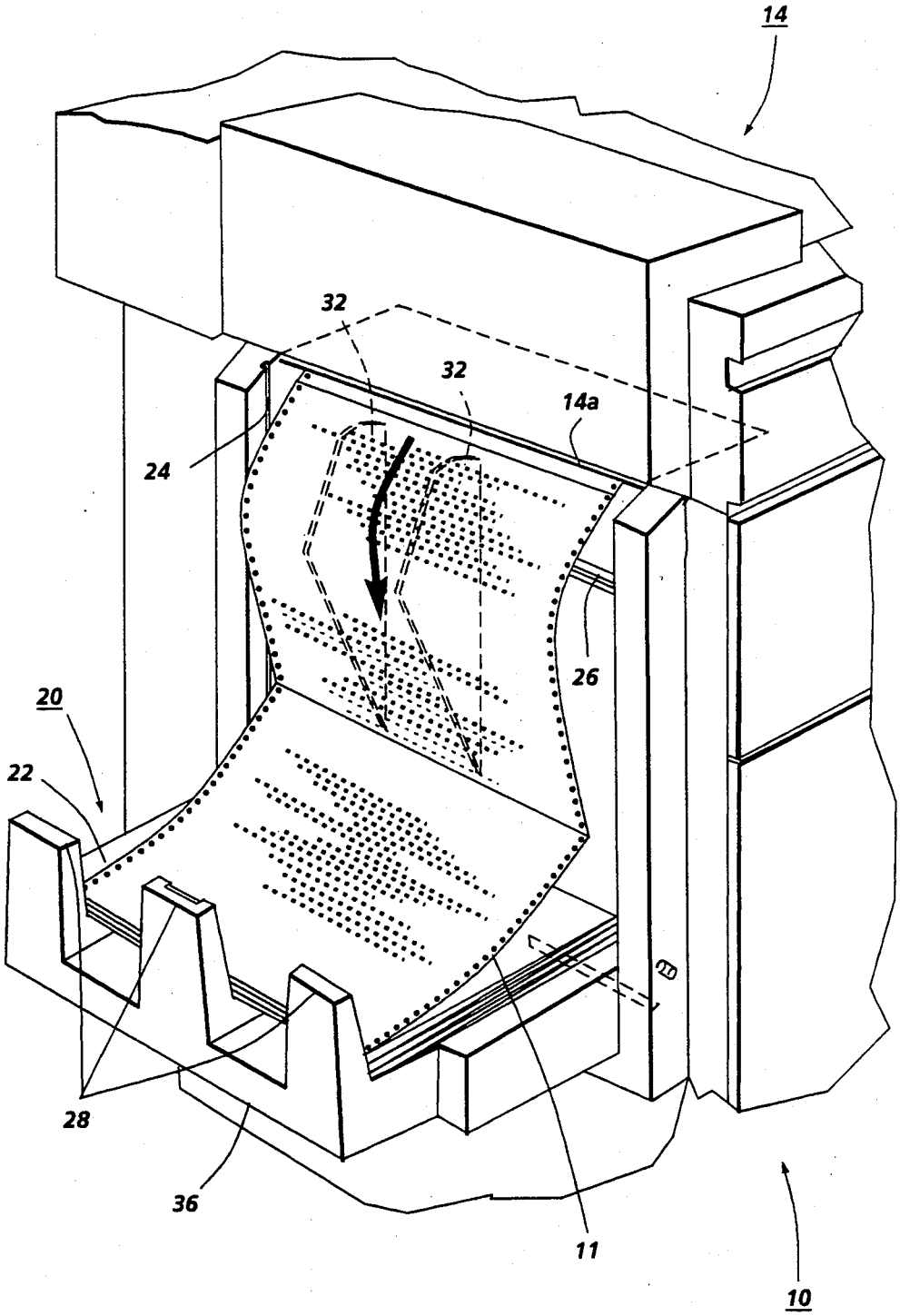
FIG. 4 is the same view as FIG. 3, showing CF web being restacked.

Disclosed here is one, single, but plural-mode function, position and use, document output tray unit 20. The tray unit 20 is preferably an integral wall unit mounted to the end of the copier adjacent the exit or output 14a of the DH 14. The unit 20 has a restacking tray or surface 22 slidably mounted by corner pins riding in a track pair 24 [or other suitable 2-position mounting], so that this one tray surface 22 can be slid up to a first or upper position adjacent the copier platen level and closely adjacent the exit or output of the DH 14 as shown in FIG. 2 for restacking regular document sheets, or slid down to a second position as shown in FIGS. 3 and 4, out of the way of desired CF restacking, at a much lower level, for holding the CF web restacking in that position. In this lowered position this same single tray 22 also can be folded up against the end of the copier 10, when not in use, as shown by the movement arrows in FIG. 3.

The tray 22 can be retained in its upper position, by for example, pivoting the tray so that integral locking fins thereunder are engaged in horizontal slots 26 in the vertical wall of the unit 20. That and the tracks 24 lock the tray 22 in that position until it is pivoted up slightly, which frees it to slide down the tracks 24 into its lower position. The tray 22 can be retained in its lower position by, for example, an integral track bottom stop there, as illustrated.

The tray surface 22 is preferably generally or approximately horizontal in both of its two operating positions. It is also preferably provided with generally vertical document end stop(s) 28, to provide a document end stop, guide, or wall at the outer end of document tray 22.

As an additional, optional, output guide feature, for smaller, e.g. standard size documents, this same tray surface 22 is disclosed with an intermediate pop-up document end wall surface portion 30 which can be pivoted up as shown in FIG. 2 to form an end stop or stack end wall usable for restacking small documents to that position, closer to the DH 14 exit. This surface portion 30 is foldable down flush with the rest of the tray surface for collecting or restacking larger document sheets on the full surface of tray 22, thus providing two different modes of operation in that tray position.

Referring particularly to FIGS. 2 and 3, an additional illustrated feature is the thin fixed pair of vertical CF restacking guide fins 32 extending arcuately out from the vertical wall of the unit 20. These fins 32 assist in re-fanfolding of the CF web onto the tray 22 (in the tray's lowered position). These fins 32 push out the CF web 11, in the CF web drop zone, as the web drops from the DH 14 output 14a to the tray 22, so that the web is positioned before restack intermediately of the tray 22, which assists in the fanfold restacking. Mating slots 34 through the tray 22 allow the tray 22 to be moved past these fins 32 without interference, and to move the tray above these fins 32 in the upper position of the tray 22, so that the fins 32 do not interfere with normal sheet collecting in that position.

As shown in phantom in FIG. 3, in this lowered tray 22 position this tray 22 can be pivotally folded up against the end of the copier 10. In that position, another mode of operation may be provided, in which optionally CF web restacking can be done not on the tray 22 but directly into a conventional cardboard box (not shown) in which CF is normally packaged, by placing that cardboard box on the floor adjacent the end of the copier 10. For this mode the outside bottom corner edge 36 of the tray 22 is preferably rounded to assist in fanfolding in that tray position in lieu of the fins 32.

Thus, is may be seen from the above that the one disclosed document tray unit 20 can optionally provide 4 different modes of operation, with only two different mounting positions, all easily changed by the copier operator.

While the embodiment disclosed herein is preferred, it will be appreciated from this teaching that various alternatives, modifications, variations or improvements therein may be made by those skilled in the art, which are intended to be encompassed by the following claims:

We claim:

1. For a copier with a document handler ejecting from its document output, original documents being copied into a document collection tray system, the improvement comprising a plural mode document collecting system for collecting and restacking different forms of documents, including both conventional sheet documents and computer form web being re-fanfolded, with a single tray means for holding discharged documents and movable between two different operative tray mounting positions, including a first tray position of said tray means adjacent said document output of said document handler for collecting conventional sheet documents and a second tray position substantially below said first tray position for re-fanfolding computer form web; said second positions causing said tray to operate with said document output of the copier to allow for the re-fanfolding of said computer form web.

2. The plural mode document collecting system of claim 1, wherein said tray means is slidably movable between said first and second tray mounting positions in a substantially vertical track and has respective retention means for retaining said tray means in either of said first and second tray mounting positions.

3. The plural mode document collecting system of claim 2, further including stationary fanfold restacking assist means mounted between said first and second tray mounting positions and operative in said second tray position to assist in re-fanfolding computer form web, said fanfold restacking assist means and said tray means being mutually adapted to allow said tray means to be moved past said fanfold restacking assist means.

4. The plural mode document collecting system of claim 1, further including stationary fanfold restacking assist means mounted intermediately of said first and second tray mounting positions and operative in said second tray position to assist in re-fanfolding computer form web, said fanfold restacking assist means and said tray means being mutually adapted to allow said tray means to be moved past said fanfold restacking assist means.

5. The plural mode document collecting system of claim 1, further including small document restacking guide means optionally operative in said first tray mounting position for restacking small documents closer to said document output of said document handler.

* * * * *